US007291040B2

(12) United States Patent
Kato

(10) Patent No.: US 7,291,040 B2
(45) Date of Patent: Nov. 6, 2007

(54) CONNECTOR FOR FLEXIBLE SUBSTRATE

(75) Inventor: Ryuhei Kato, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 11/356,185

(22) Filed: Feb. 17, 2006

(65) Prior Publication Data

US 2006/0189190 A1 Aug. 24, 2006

(30) Foreign Application Priority Data

Feb. 24, 2005 (JP) ..... 2005-048116

(51) Int. Cl.
*H01R 12/24* (2006.01)

(52) U.S. Cl. ..... 439/495

(58) Field of Classification Search ..... 439/495
See application file for complete search history.

(56) References Cited

U.S. PATENT DOCUMENTS 5,785,549 A * 7/1998 Takayasu ..... 439/495
6,790,074 B1 * 9/2004 Chiu ..... 439/495
2005/0260885 A1 * 11/2005 Lu ..... 439/495

FOREIGN PATENT DOCUMENTS

| | | |
|---|---|---|
| EP | 1 049 200 | 11/2000 |
| EP | 1 148 590 | 10/2001 |
| JP | 3295808 | 4/2002 |
| JP | 3513751 | 1/2004 |

* cited by examiner

*Primary Examiner*—Neil Abrams
(74) *Attorney, Agent, or Firm*—Kratz, Quintos & Hanson, LLP

(57) ABSTRACT

An actuator is rotatably combined with a body configured so that the end of the flexible substrate is inserted from the front surface side. The body holds a plurality of contacts arranged in paralleland contacting the terminals on the end of the inserted substrate. The actuator includes a plurality of cams corresponding to the plurality of contacts within the body, and presses the end of the inserted substrate with the plurality of cams when turned from the opened state to the closed state. Each of the contacts includes a contacting point part for pressure contacting the terminal on the end of the substrate and a hook of hook shape for engaging and holding the shaft formed in the actuator, and also includes a cover for covering the rear surface side of the body when turned to the closed state.

6 Claims, 12 Drawing Sheets

(a)

(b)

(a)

ACTUATOR OPENED STATE (b)

ACTUATOR CLOSED STATE (a)

ACTUATOR OPENED STATE

ACTUATOR CLOSED STATE

EXPLODED VIEW

ACTUATOR

BODY (a)

(b)

(a)

(b)

(a)

(b)

(a)

(b)

CONNECTOR FOR FLEXIBLE SUBSTRATE

The present application claims priority under 35 U.S.C. [section] 119 of Japanese Patent Application No. JP 2005-048116 filed on Feb. 24, 2005, the disclosure of which is expressly incorporated by reference herein in its entirety.

BACKGROUND OF THE INVENTION

1. Field of the Invention

The present invention relates to a connector for flexible substrate used for attaching a flexible substrate.

2. Description of the Related Art

The connector for flexible substrate is conventionally used to mount the flexible substrate to a main substrate. Normally, the connector is made up of a body for holding a plurality of contacts arranged in parallel, each contacting a plurality of terminals formed on the end of the flexible substrate; and an actuator rotatably combined with the body. The plurality of contacts held by the body has one part exposed to the outside of the body as a soldering part, and is mechanically and electrically connected to the main substrate by way of the soldering part.

The actuator downwardly presses the end of the flexible substrate inserted from the front surface side by being turned from an opened position to a closed position and fixes the same. Thus, the corresponding contact elastically contacts the plurality of terminals formed on the back surface of the end to electrically and mechanically connect the flexible substrate to the connector. One type of actuator includes a plurality of cams corresponding to a plurality of contacts in order to ensure that the end of the flexible substrate is pressed (refer to Japanese Laid-Open Patent Publication No. 3295808 and Japanese Laid-Open Patent Publication No. 3513751).

In the conventional connector for flexible substrate, there is a problem that the actuator in turning operation easily falls off. That is, in the conventional connector, although the actuator is pivotally supported at the ends on both sides of the body, or is pivotally supported using one part of contacts held by the body, the actuator easily falls off since it is subjected to a large reactive force from the flexible substrate during the turning operation.

A problem arises that when external force, in particular, the upward external force is applied to the flexible substrate after being attached and connected, the contacting point pressure tends to lower. That is, since the terminal at the flexible substrate is formed at the back surface of the end, the terminal easily separates away from the contacting point part on the lower side when the flexible substrate rises. This problem is especially significant when pivotally supporting the actuator using one part of contacts. This is because the relevant contact is easily deformed upward when the upward external force is applied to the flexible substrate.

Another further problem is that foreign materials tend to attach to each soldering part of a plurality of contacts projecting outward of the body after being mounted to the main substrate, which may cause short circuit. The contact may be attached to the body from the front surface side or may be attached from the rear surface side. When attached from the front surface side, the soldering part is exposed on the front surface side of the body, and when attached from the rear surface side, the soldering part is exposed on the rear surface side. In the former case, foreign materials are less likely to attach since the soldering part is covered by the flexible substrate attached from the front surface side. However, in the latter case, the soldering part is exposed on the rear surface side even after the flexible substrate is mounted, and thus short circuit may occur due to attachment of foreign particles.

SUMMARY OF THE INVENTION

The present invention, in view of the above, aims to provide a connector for flexible substrate that can effectively prevent the actuator in the turning operation from falling off.

The present invention also aims to provide a connector for flexible substrate excelling in contacting stability that can effectively prevent lowering of contacting point pressure even when the upward external force is applied to the flexible substrate after being attached and connected.

The present invention also aims to provide a connector for flexible substrate that can effectively resolve the possibility of short circuit caused by attachment of foreign materials even when the soldering part of the contact is projected on the rear surface side of the body.

In order to achieve the above aim, the connector for flexible substrate according to the present invention includes a body, configured to insert an end of the flexible substrate thereinto from a front surface side thereof, for holding a plurality of contacts arranged in parallel for respectively contacting a plurality of terminals arranged on the end of the inserted substrate; and an actuator, rotatably combined with the body, including a plurality of cams corresponding to the plurality of contacts within the body, and pressing the end of the inserted substrate with the plurality of cams by being turned from an opened state to a closed state so as to bring the terminals at the end of the substrate into contact with the corresponding contacts; wherein each of said contacts includes a contacting point part for pressure-contacting to the terminal on the end of the substrate and a hook of hook shape for engaging and holding a shaft formed in the actuator; the hook engages the cam from the front surface side so as to restrain the actuator from moving toward the front surface side; and the body includes a restraining part for contacting the cam from a rear side of the body so as to restrain the actuator from moving toward the rear surface side.

The shaft is preferably formed between the adjacent cams. Thus, the turning of the cam becomes smooth, and the function of the cam is effectively exhibited.

In the connector for flexible substrate according to the present invention, each of the contacts corresponding to the terminal of the end of the substrate includes a contacting point part for elastically contacting the terminal and a hook of a hook shape that engages the shaft of the actuator. The actuator is less likely to separate during the turning operation due to the support by the hook. Further, the hook engages the cam from the front surface side to inhibit the movement of the actuator towards the front surface side, and the body includes a restraining part for contacting the cam from the rear surface side to inhibit the movement of the actuator from the rear surface side. Such configuration is particularly effective in inhibiting the separation of the actuator.

With regards to the contact, a preferable configuration is that the contacting point part is positioned on the lower side of the end of the substrate inserted from the front surface side, the hook is positioned on the upper side, and the contacting point part and the hook are coupled and integrated at the base. In such configuration, when the upward external force is applied to the flexible substrate connected to the connector, the hook on the upper side rises while the contacting point part on the lower side also rises. Thus, such configuration can prevent decrease in contacting point pressure.

The body may have a configuration of holding two types of contact. Particularly, the body may hold a first contact attached from the front surface side of the body and including a soldering part on the front surface side, and a second contact attached from the rear surface side and including a soldering part on the rear surface side. Thus, the interference of the soldering parts between adjacent contacts can be avoided, and the arrangement pitch of the connectors can be reduced.

In this case, the first contact has a configuration of including both the contacting point part and the hook. The second contact preferably includes a contacting point part for pressure contacting the terminal of the end of the substrate as well as a pressing part for elastically pressing a part of the actuator from above when the actuator is in the closed state. According to this configuration, the second contact can contribute to holding the flexible substrate.

The actuator includes a cover for covering the rear surface side of the body when turned to the closed state. According to this configuration, the soldering part is covered with the cover of the actuator, and the possibility of short circuit caused by attachment of foreign materials is resolved even in a case of contacts attached from the rear surface side and having the soldering part exposed toward the rear surface side.

When the body holds two types of contact, the cover of the actuator covers the soldering part of the second contact. On the other hand, the soldering part of the first contact is covered by the attached flexible substrate and thus short circuit caused by attachment of foreign materials is not a great problem, as mentioned above.

In the connector for flexible substrate according to the present invention, each of a plurality of contacts corresponding to the respective terminals on the end of the substrate includes a contacting point part for elastically contacting the terminal and a hook of hook shape for engaging the shaft of the actuator, and the hook engages the cam from the front surface side to inhibit the movement of the actuator towards the front surface side, the body includes a restraining part that contacts the cam from the rear surface side to inhibit the movement of the actuator towards the rear surface side, and thereby the actuator can be effectively prevented from falling off during the turning operation.

If the contact has a configuration that the contacting point part thereof is positioned at the lower side of the end of the substrate inserted from the front surface side, the hook is positioned at the upper side, and the contacting point part and the hook are coupled and integrated at the base, the lowering of the contacting point pressure can be effectively prevented even if the upward external force is applied to the flexible substrate after being attached and connected.

When the actuator includes a cover for covering the rear surface side of the body when it is turned to the closed state, the possibility of the short circuit caused by attachment of the foreign materials can be effectively resolved even when the soldering part of the contact is projected to the rear surface side of the body.

DETAILED DESCRIPTION OF THE PREFERRED EMBODIMENTS.

The embodiments of the present invention will now be explained based on the drawings.

Figure 1:
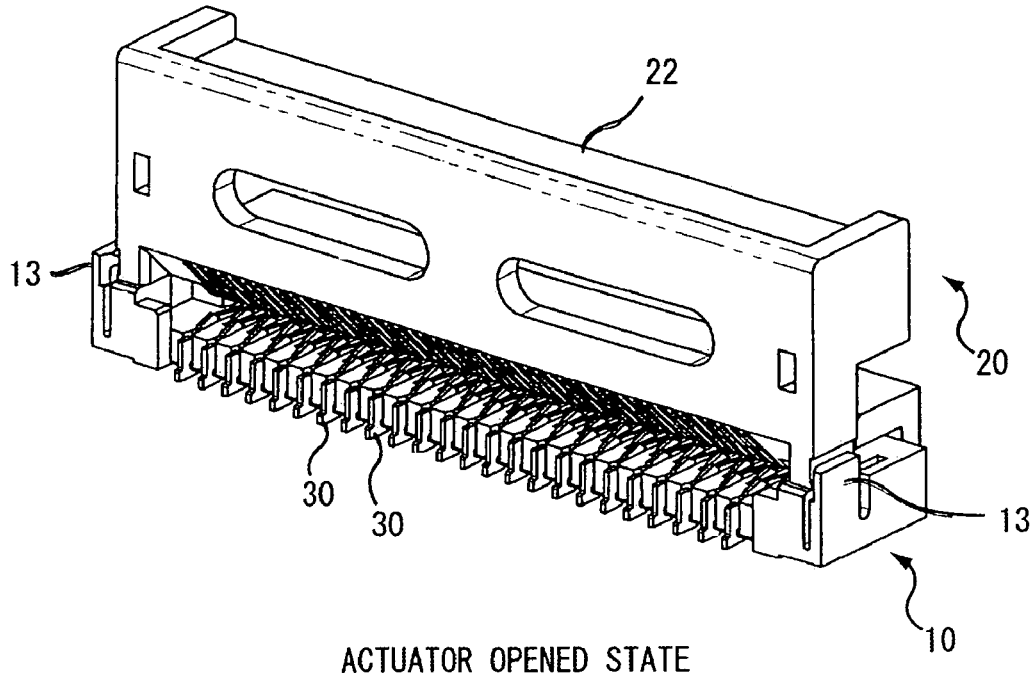
FIG. 1 is a perspective view of a connector for flexible substrate according to a first embodiment of the present invention seen from the front surface side, where (a) shows a state in which an actuator is opened, and (b) shows a state in which the actuator is closed, respectively.
Figure 1:
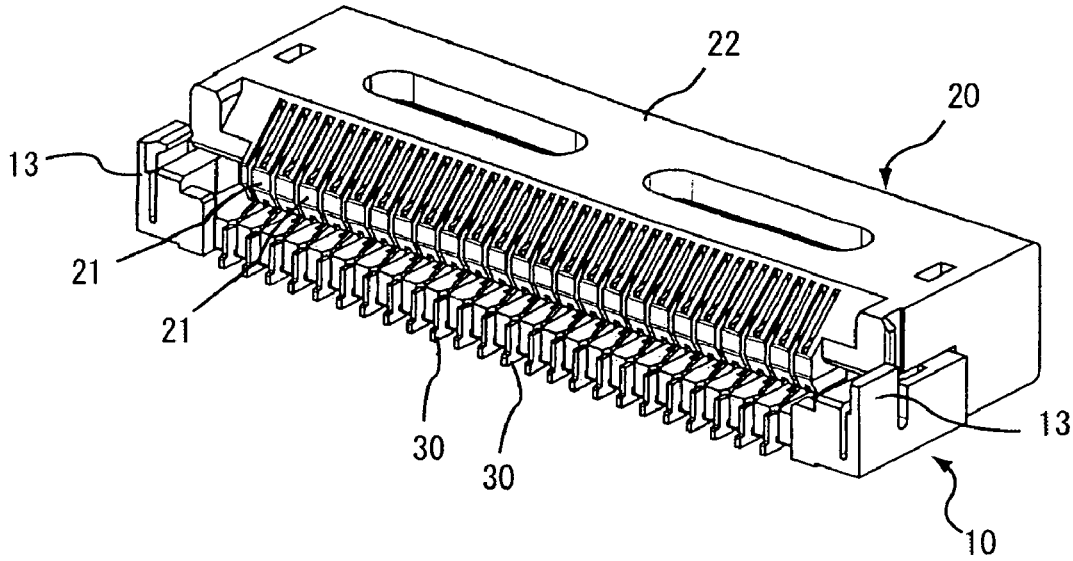
Figure 2:
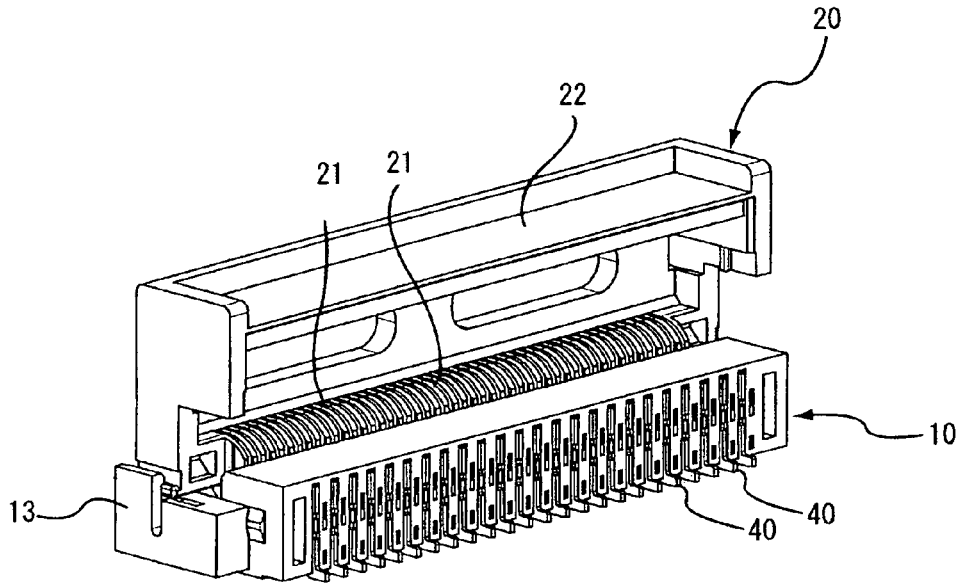
FIG. 2 is a perspective view of the connector for flexible substrate seen from the rear surface side, where (a) shows a state in which an actuator is opened, and (b) shows a state in which the actuator is closed, respectively.
Figure 2:
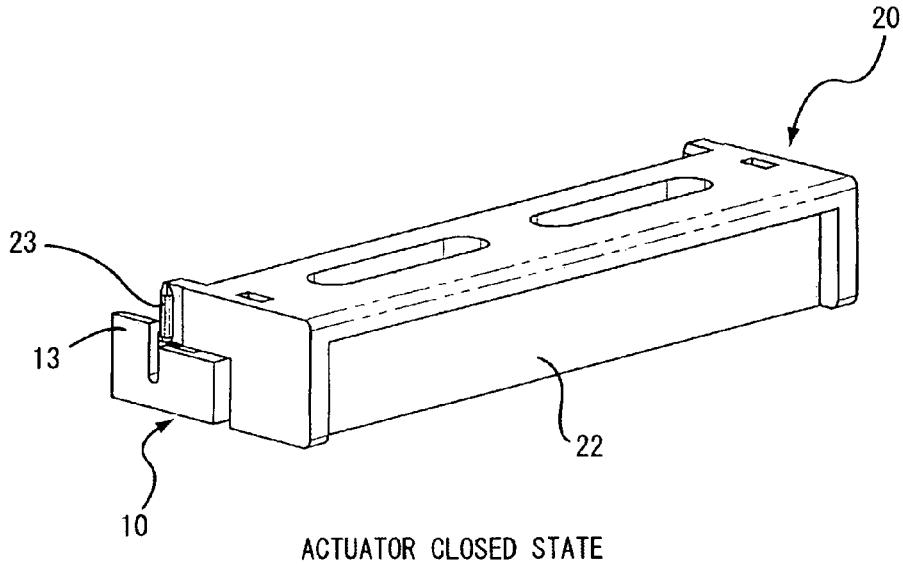
Figure 3:
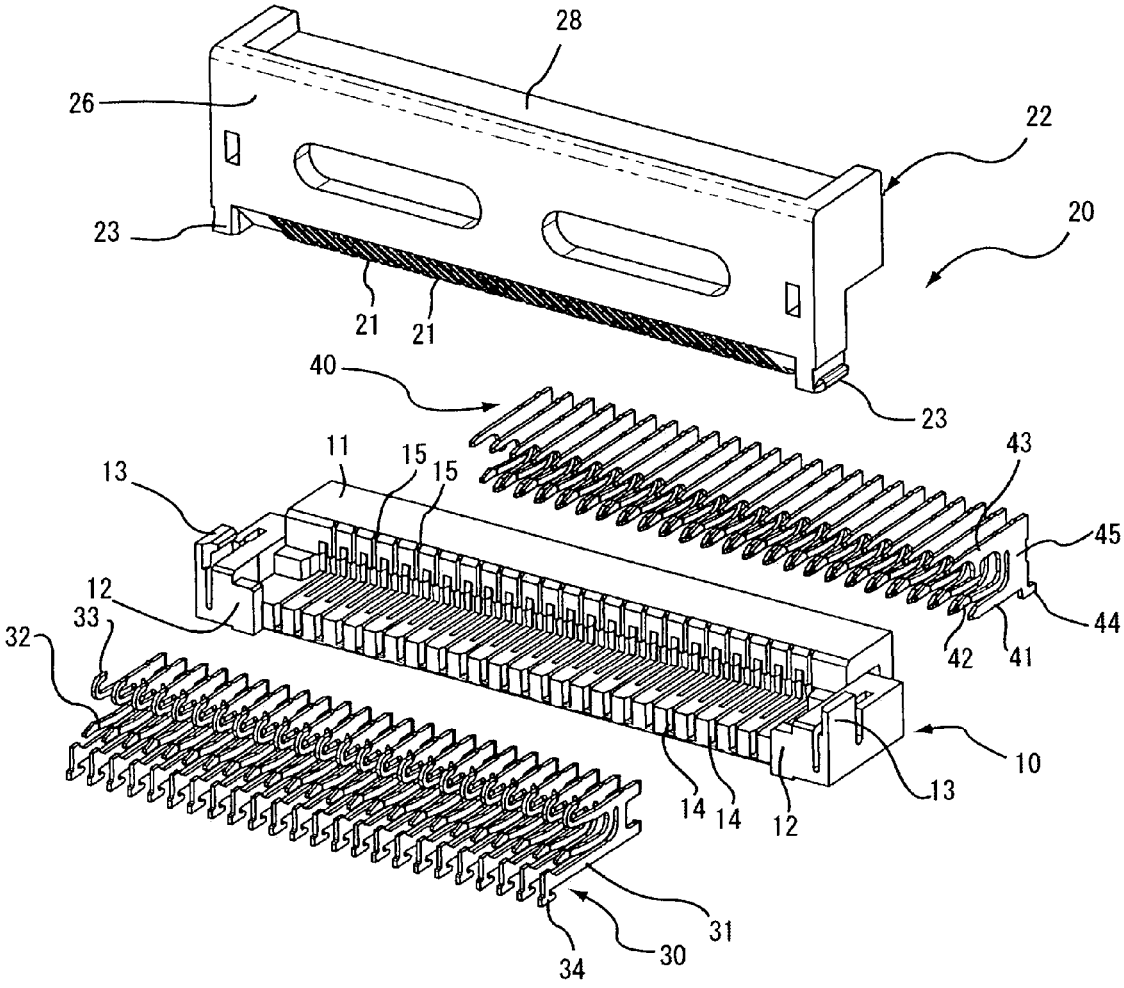
FIG. 3 is an exploded perspective view of the actuator for flexible substrate showing a state in which the actuator is opened from the front surface side.

FIG. 1 is a perspective view of a connector for flexible substrate according to a first embodiment of the present invention seen from the front surface side, where (a) shows a state in which the actuator is opened, and (b) shows a state in which the actuator is closed. FIG. 2 shows a perspective view of the connector for flexible substrate seen from the rear surface side, where (a) shows a state in which the actuator is opened, and (b) shows a state in which the actuator is closed. FIG. 3 is an exploded perspective view of the actuator for flexible substrate and shows a state in which the actuator is opened from the front surface side.

Figure 4:
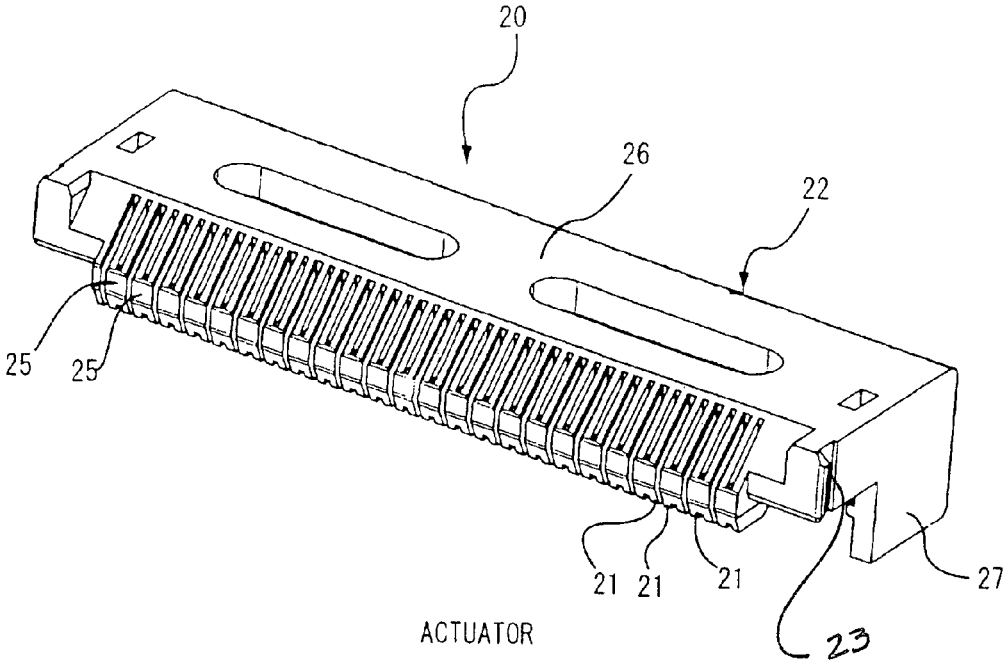
FIG. 4 is a perspective view showing the body and the actuator of the connector for flexible substrate in an exploded manner, showing a state in which the actuator is closed from the front surface side.
Figure 4:
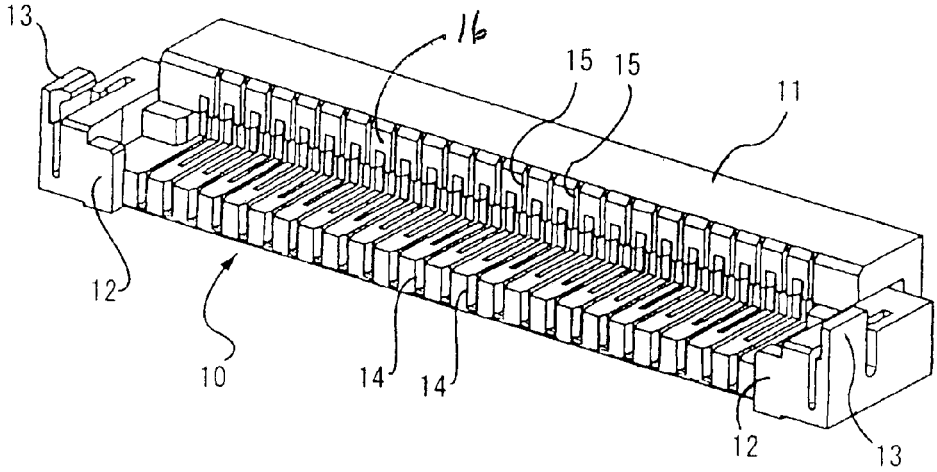
Figure 5:
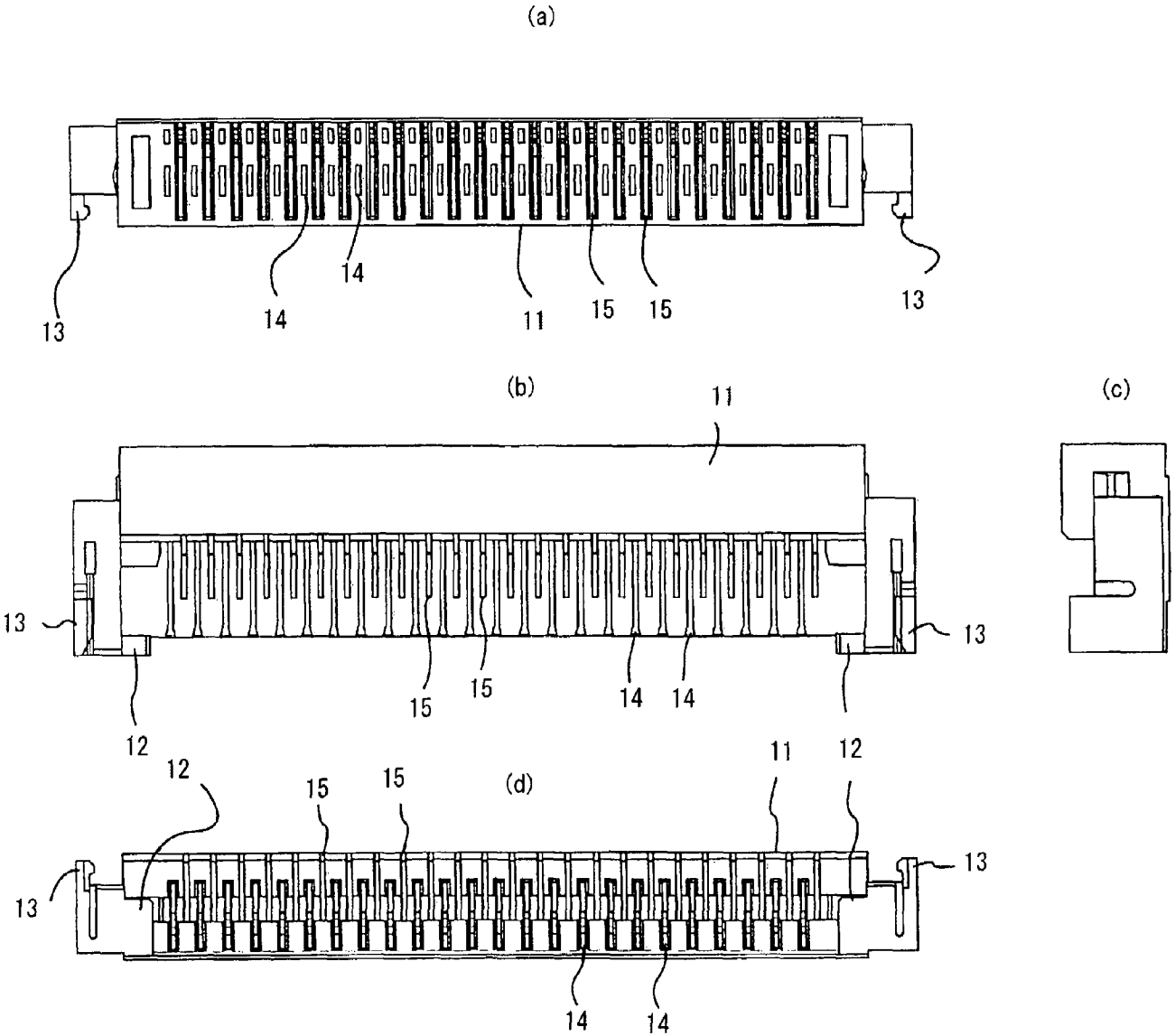
FIG. 5 is a 4 plane view of the body where (a) is a rear view, (b) is a plan view, (c) is a side view and (d) is a front view.
Figure 6:
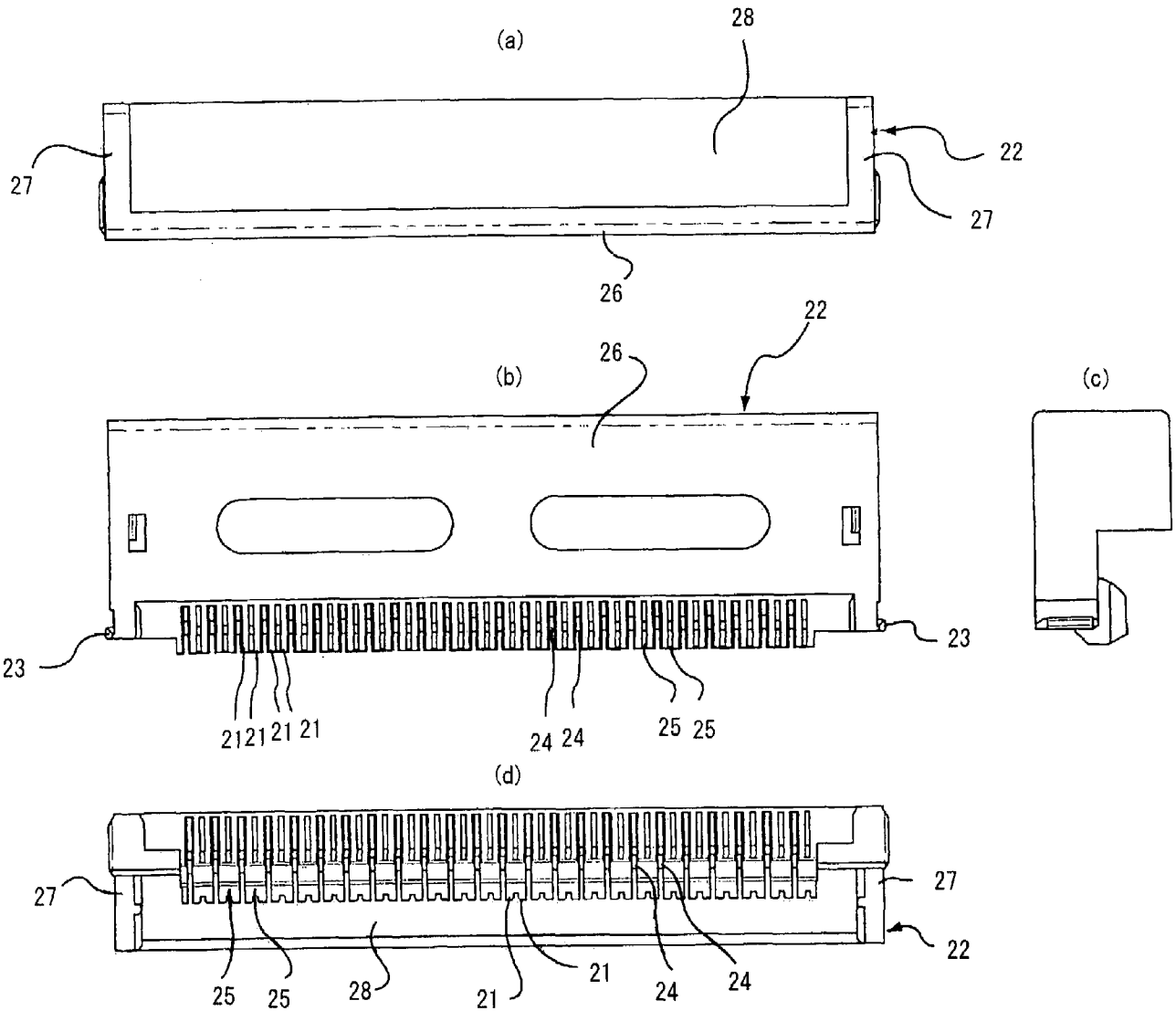
FIG. 6 is a 4 plane view of the actuator, where (a) is a rear view, (b) is a plan view, (c) is a side view and (d) is a front view in a closed state.

FIG. 4, is a perspective view showing the body and the actuator of the connector for flexible substrate in an exploded manner, and shows the state in which the actuator is closed from the front surface side. FIG. 5 is a 4 plane view of the body where (a) is an upside down rear view, (b) is a plan view, (c) is a side view and (d) is a front view. FIG. 6 is a 4 plane view of the actuator, where (a) is a rear view, (b) is a plan view, (c) is a side view and (d) is a front view in a closed state.

Figure 7:
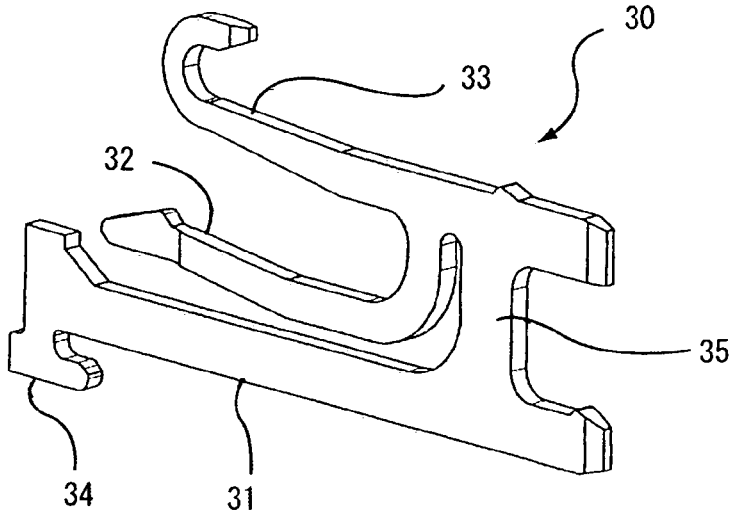
FIG. 7 is a perspective view of each of two types of contact held by the body, where (a) shows a first contact and (b) shows a second contact.
Figure 7:
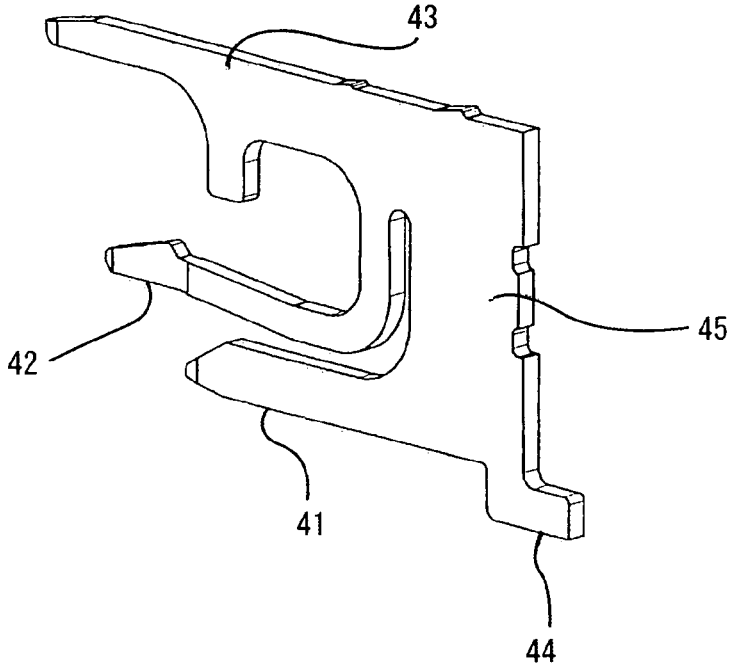
Figure 8:
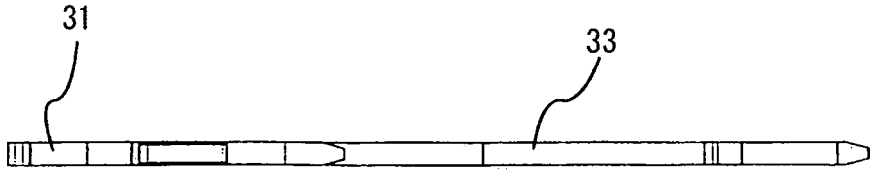
FIG. 8 is a 2 plane view of the first contact, where (a) is a plan view and (b) is a side view.
Figure 8:
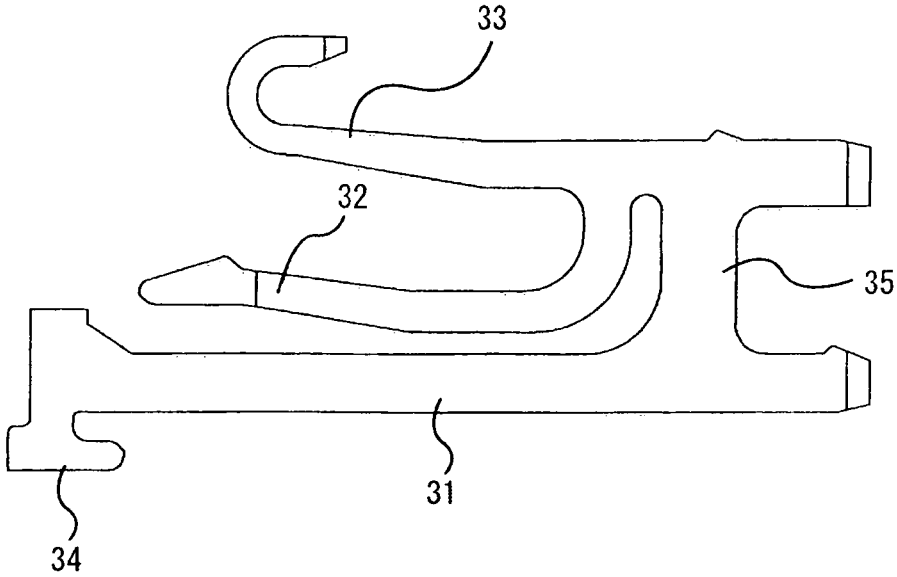

FIG. 7 is a perspective view of each of two types of contact held by the body, where (a) shows a first contact and (b) shows a second contact. FIG. 8 is a 2 plane view of the first contact, where (a) is a plan view and (b) is a side view.

Figure 9:
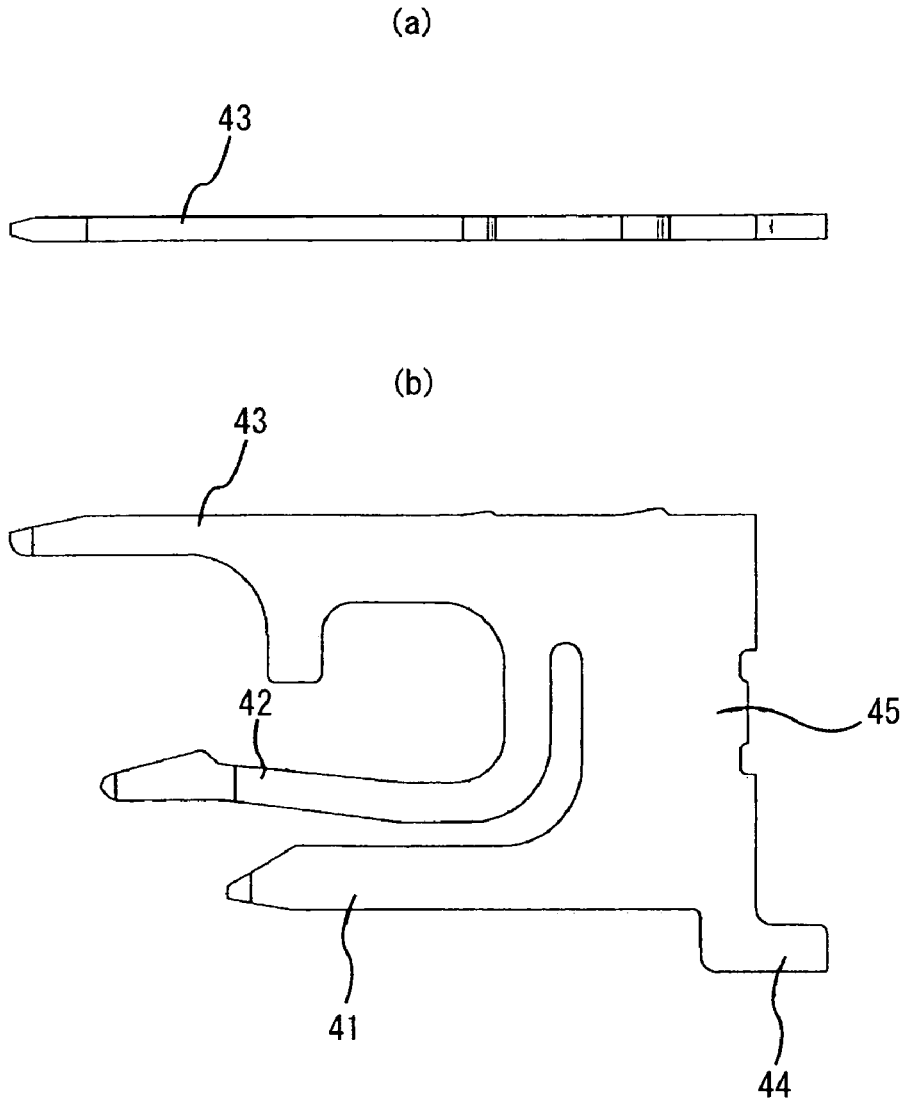
FIG. 9 is a 2 plane view of the second contact, where (a) is a plan view and (b) is a side view.
Figure 10:
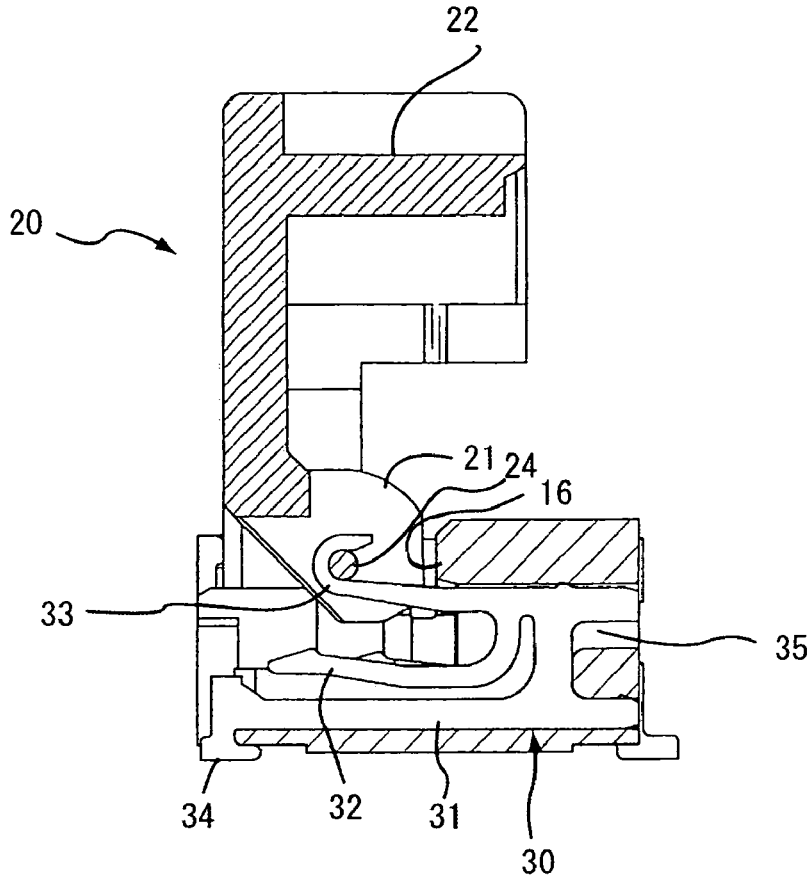
FIG. 10 is a longitudinal cross sectional view showing the operation of the first contact involved in opening and closing of the actuator, where (a) shows the opened state and (b) shows the closed state.
Figure 10:
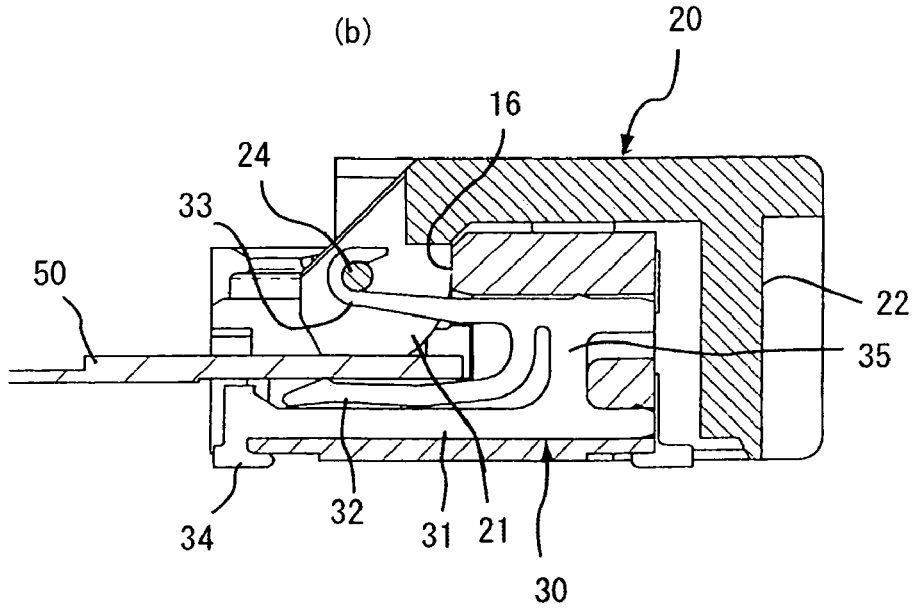
Figure 11:
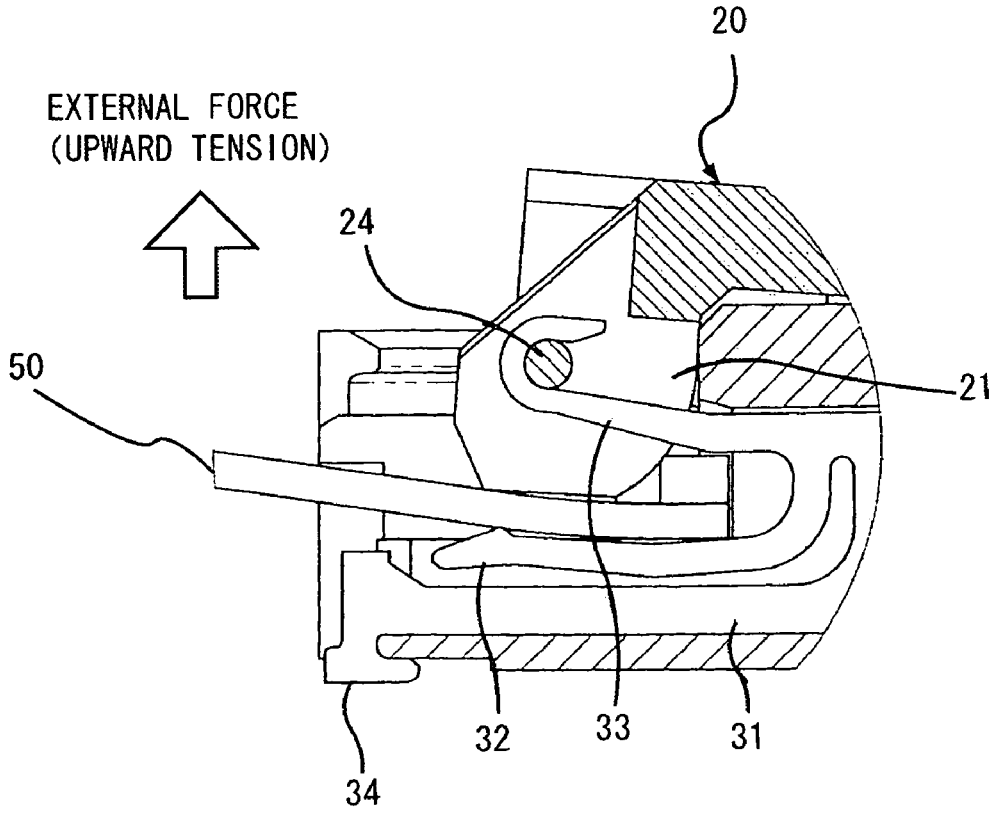
FIG. 11 is a longitudinal cross sectional view showing the operation of the first contact when the upward external force is applied to the attached flexible substrate.
Figure 12:
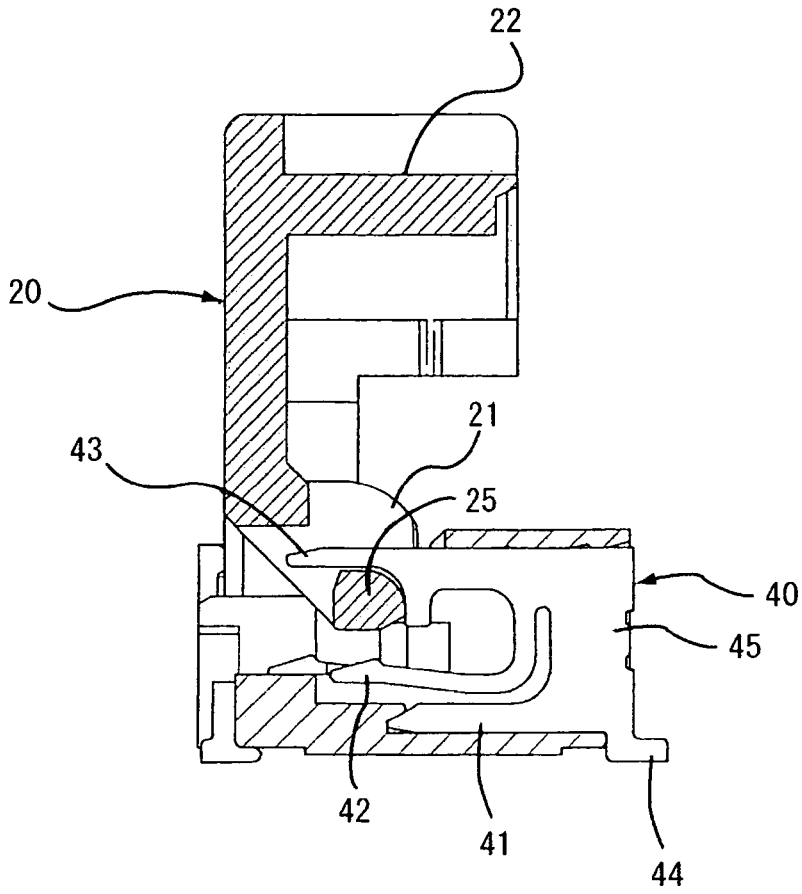
FIG. 12 is a longitudinal cross sectional view showing the operation of the second contact involved in opening and closing of the actuator, where (a) shows the opened state and (b) shows the closed state.
Figure 12:
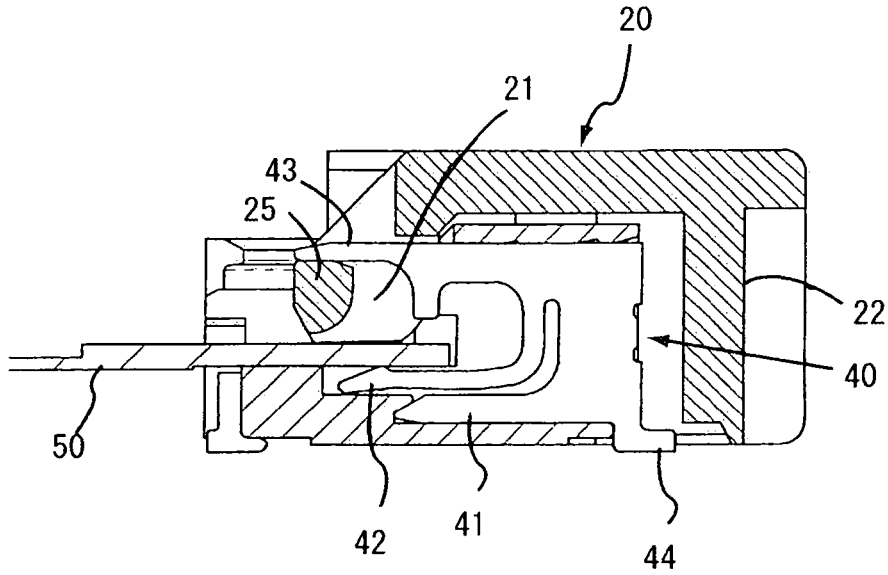

FIG. 9 is a 2 plane view of the second contact, where (a) is a plan view and (b) is a side view. FIG. 10 is a longitudinal cross sectional view showing the operation of the first contact involved in opening and closing of the actuator, where (a) shows the opened state and (b) shows the closed state. FIG. 11 is a longitudinal cross sectional view showing the operation of the first contact when the upward external force is applied to the attached flexible substrate. FIG. 12 is a longitudinal cross sectional view showing the operation of the second contact involved in opening and closing of the actuator, where (a) shows the opened state and (b) shows the closed state.

The connector for flexible substrate according to the present embodiment includes a horizontal body 10 for holding, in parallel, multiple contacts at a predetermined interval in the lateral direction; and a horizontal actuator 20, rotatably combined with the body 10, for gripping the end of the flexible substrate between the body 10 by being turned from the opened state to the closed state to electrically and mechanically connect with the flexible substrate, both of which are made of resin, as shown in FIG. 1 to FIG. 4. A first contact 30 attached to the body 10 from the front side and a second contact 40 attached to the body 10 from the rear side are used as the contact, both of which are configured by a metal plate.

The body 10 includes a main body 11 with an L-shaped cross section at the portion excluding the ends on both sides, as shown in FIG. 4 and FIG. 5. The main body 11 has the horizontal part projecting towards the front surface side and the vertical part projecting upward so as to receive the ends of the flexible substrate at the horizontal part. The ends on both sides of the body 10 are substrate guiding parts 12, 12 for guiding the flexible substrate from both sides, and the both sides thereof are actuator holding parts 13, 13 for holding the actuator 20 in the opened state.

A first inserting part 14 of a longitudinal slit shape to where the first contact 30 is inserted from the front surface side is arranged on the main body 11 of the body 10 at a predetermined pitch (pitch of twice the contact arrangement pitch) in the width direction. The first inserting part 14 is opened at the front surface of the horizontal part, the upper surface of the horizontal part and the front surface of the vertical part of the main body 11, and is opened in two steps vertically at the rear surface of the vertical part. A second inserting part 15 of longitudinal slit shape to where the second contact 40 is inserted from the rear surface side is positioned between the adjacent first inserting parts 14, 14 on the main body 11. The second inserting part 15 is opened at the upper surface of the horizontal part, the front surface of the vertical part, and the rear surface of the vertical part.

The actuator 20 includes, as shown in FIG. 4 and FIG. 6, multiple cams 21 of plate shape juxtaposed at a predetermined interval in the width direction at the portion excluding the ends on both sides of the front surface side, and includes a cover 22 at the back thereof. The ends on both sides of the front surface side are actuator holding parts 23, 23 for holding the actuator 20 in the opened state in cooperation with the holding parts 13, 13 of the body 10.

The multiple cams 21 are plate materials of substantially fan shape having an eccentric outer peripheral surface, is received in a space surrounded by the horizontal part and the vertical part of the body 10, and is on the turning center line of the actuator 20 and presses the end of the flexible substrate mounted on the horizontal part of the body 10 from the upper side when it is turned from the opened state to the closed state. The front surface of the vertical part of the body 10, in particular, between the first inserting part 14 and the second inserting part 15 is a restraining part 16 for supporting the multiple cams 21 from the rear surface side when the actuator 20 is turned from the opened state to the closed state (refer to FIG. 10).

Theses cams 21 are grouped to have two adjacent ones in one group, and the two cams 21, 21 in the one group are coupled by a pressed part 25 at the distal end. The two adjacent cams 21, 21 are coupled by a shaft 24 between the adjacent groups.

The shaft 24 is a supporting axis in which the cross section to be the turning center of the actuator 20 is a circle, and is arranged between the turning centers of the adjacent cams 21, 21. The supporting shaft 24 is at a position corresponding to the first inserting part 14 of the body 10, that is, the first contact 30 attached to the body 10. On the other hand, the pressed part 25 is at a position corresponding to the second inserting part 15 of the body 10, that is, the second contact 40 attached to the body 10. Therefore, the end of the flexible substrate mounted on the horizontal part of the body 10 is pressed with both sides of each contact by the multiple cams 21.

The cover 22 of the actuator 20 has a configuration of covering the portion excluding the front end of the body 10 from above, both sides and the rear side in the closed state turned to the rear surface side, more specifically, is configured by three portions of a top plate 26 serving as a roof, side plates 27, 27 on both sides, and a rear plate 28 serving as a rear surface plate in the closed state. Further, the multiple cams 21 mentioned above are integrally formed at the up-front part of the top plate 26.

The first contact 30 incorporated in the body 10 is a processed article of a vertical metal plate, as shown in FIG. 7(*a*) and FIG. 8, and includes a horizontal holding part 31 at the lowest part and includes an arm shaped contacting point part 32 thereabove, and an arm shaped hook 33 further above. The first contact 30 is inserted to the first inserting part 14 of the body 10 from the front surface side, as mentioned above.

The holding part 31 is fixed within the first inserting part 24 of the body 10 with the end on the rear surface side of the first contact 30 (refer to FIG. 10). The rear end in the inserting direction of the holding part 31, that is, the end on the front surface side is a soldering part 34 projecting outward of the body 10. The contacting point part 32 is a substantially horizontal arm extending from the rear surface side to the front surface side, and includes a contacting part at the distal end that contacts the terminal formed on the back surface of the end of the flexible substrate from below, and projects upward from the upper surface of the horizontal part of the body 10 when the flexible substrate is not attached.

The hook 33 of the first contact 30 has the distal end of a substantially horizontal arm extending from the rear surface side to the front surface side formed into a hook shape curved upward into a substantially semicircular shape. The curved portion of the distal end is positioned between the adjacent cams 21, 21 of the actuator 20 combined with the body 10, and is fitted to the shaft 24 of the actuator 20 from the front surface side.

The end on the rear surface side of the hook 33 is connected to the upper end of the supporting part 35 extending vertically from the end on the rear surface side of the holding part 31. The end on the rear surface side of the contacting point part 32 is curved upward and connected to the hook 33 before the supporting part 35. That is, the contacting point 32 and the hook 33 are formed into a lateral U-shape opening out to the front surface side, and are supported on one side at the front surface side of the supporting part 35. Thus, the contacting point part 32 and the hook 33 are integral with the basal side as the supporting point and are elastically displaceable in the up and down direction.

The second contact 40 is, as shown in FIG. 7(*b*) and FIG. 9, a processed article of vertical metal plate, includes a horizontal holding part 41 at the lowest part, an arm shaped contacting point part 42 thereabove, and an arm shaped pressing part 43 further above. The second contact 40 is inserted to the second inserting part 15 of the body 10 from the rear surface side, as mentioned above.

The holding part 41 is fixed within the second inserting part 15 of the body 10 with the end of the rear surface side of the second contacting point 40 (refer to FIG. 12). The rear end in the inserting direction of the holding part 41, that is, the end on the rear surface side is a soldering part 44 projecting outward of the body 10. The contacting pointing part 42 is a substantially horizontal arm extending from the rear surface side to the front surface side, and includes a contacting part at the distal end that contacts the terminal formed on the back surface of the end of the flexible substrate from below, and projects upward from the upper surface of the horizontal part of the body 10 when the flexible substrate is not attached.

The pressing part 43 of the second contact 40 is a substantially horizontal arm extending from the rear surface side to the front surface side, and includes an engaging part at the distal end that contacts the pressed part 25 arranged between the adjacent cams 21, 21 of the actuator 20 from the upper side and the rear surface side. On the other hand, the end on the rear surface side of the pressing part 43 is connected to the upper end of the supporting part 45 extending vertically from the end on the rear surface side of the holding part 41. Further, the end on the rear surface side of the contacting point part 42 is curved upward, and is connected to the pressing part 43 before the supporting part 45.

That is, similar to the contacting point part 32 and the hook 33 of the first contact 30, the contacting point part 42 and the pressing part 43 are formed into a lateral U-shape opening out to the front surface side of the supporting part 45 and thus, are integral with the basal side as the supporting point and are elastically displaceable in the up and down direction.

The method of assembling, the method of operating and the function of the connector for flexible substrate according to the present embodiment will now be explained.

Prior to attaching the first contact 30 and the second contact 40 to the body 10, the actuator 20 is combined to the body 10 in an opened state. Here, the holding parts 13, 13 of the body 10 and the holding parts 23, 23 of the actuator 20 are engaged, and the actuator 20 is held and fixed in the opened state. In this state, the first contact 30 is inserted to the first inserting part 14 of the body 10 from the front surface side and the second contact 40 is inserted to the second inserting part 15 from the rear surface side.

In inserting the first contact 30, the distal end portion of the hook 33 of the first contact 30 is fitted to the shaft 24 of the actuator 20 from the front surface side, as shown in FIG. 10 (*a*). In inserting the second contact 40, the distal end portion of the pressing part 43 of the second contact 40 is fitted to the pressed part 25 of the actuator 20 from the rear surface side, as shown in FIG. 12 (*a*). The actuator 20 is thereby rotatably connected to the body 10 by means of the first contact 30 and the second contact 40 attached to the body 10.

Here, the actuator 20 is in the opened state, and is upraised on the horizontal part of the body 10 with the cam 21 facing downward with a slight gap. In this state, the end of the flexible substrate 50 is inserted between the horizontal part of the body 10 and the cam 21 of the actuator 20, and the actuator 20 is turned towards the rear surface side, as shown in FIG. 10(*b*) and FIG. 12(*b*). The actuator 20 is turned from the opened state to the closed state with the shaft 24 as the center. As a result, the end of the flexible substrate 50 is pressed downward between the adjacent contacts by multiple cams 21, and is pressed against the upper surface of the horizontal part of the body 10. The contacting point part 32 of the first contact 30 and the contacting point 42 of the second contact 40 thus elastically deform downward and elastically contact the multiple terminals formed on the back surface of the end due to the reactive force. The flexible substrate 50 is thereby electrically and mechanically connected to the connector.

It is essential that the hook 33 of the first contact 30 is engaged to the shaft 24 of the actuator 20. Through such engagement, the displacement to the front surface side, the displacement to the lower side, and the displacement to the upper side of the actuator 20 are inhibited. Further, the displacement to the rear surface side is inhibited when the cam 21 contacts the restraining part 16 of the body 10. Thus, the actuator 20 is reliably supported during the turning operation and does not fall off.

When the turning of the actuator 20 to the closed state is completed, the pressing part 43 of the second contact 40 elastically contacts the pressed part 25 of the actuator 20 from the upper side. Thus, the multiple cams 21 of the actuator 20 strongly press the end of the flexible substrate 50 between the contacts from the upper side. Therefore, the flexible substrate 50 that is attached and connected is strongly held and is effectively prevented from floating towards the upper side.

The soldering part 44 of the second contact 40 is exposed on the rear surface side of the body 10. However, the rear surface side of the body 10 is covered by the cover 22 of the actuator 20 turned to the closed state. Thus, attachment of foreign materials to the soldering part 44 is suppressed and short circuit caused by the attachment of foreign materials does not occur. Although the soldering part 34 of the first contact 30 is exposed to the front surface side of the body 10, attachment of foreign materials is substantially small since it is covered by the flexible substrate 50 attached to the connector from the front surface side, and thus short circuit caused by the attachment of foreign materials does not occur.

The flexible substrate 50 still floats when a strong upward external force is applied to the attached flexible substrate 50. However, the contacting point part 32 of the first contact 30 is integrated with the hook 33 and can be elastically displaced in the up and down direction. Thus, as shown in FIG. 11, when the flexible substrate 50 floats, the cam 21 thereabove also floats and the hook 33 is displaced and deformed to the upper side with the cam 21. Thus, the contacting point part 32 on the lower side is also displaced and deformed to the upper side with the hook 33, and the contact with the terminal of the flexible substrate 10 is maintained. With regards to the second contact 40, the contacting point 42 on the lower side is displaced and deformed to the upper side with the displacement and deformation to the upper side of the pressing part 43, and thus the contact with the terminal of the flexible substrate 10 is maintained. Therefore, lowering of contacting point pressure is suppressed at such contacts, and contacting stability is enhanced.

What is claimed is:

1. A connector for a flexible substrate comprising:

a body, configured to insert an end of the flexible substrate thereinto from a front surface side thereof, for holding a plurality of contacts arranged in parallel for respectively contacting a plurality of terminals arranged on the end of the inserted substrate; and an actuator, including a plurality of cams corresponding to the plurality of contacts within the body, and a plurality of shafts arranged between the plurality of cams; wherein each of said contacts includes a contacting point part for contacting a corresponding one of the terminals on the end of the substrate and a hook of hook shape for engaging and holding a corresponding one of the shafts formed in the actuator;

the actuator, upon rotating about the plurality of shafts from an opened state to a closed state, presses the inserted substrate with the plurality of cams so as to bring the terminals at the end of the substrate into contact with the corresponding contacts, the hooks engage the shafts from the front surface side so as to restrain the actuator from moving toward the front surface side; and the body includes a restraining part for abutting the plurality of cams from a rear side of the body so as to restrain the actuator from moving toward the rear surface side.

2. The connector for a flexible substrate according to claim 1, wherein each of the said contacts has the contacting point part positioned on a lower side of the end of the flexible substrate inserted from the front surface side, the hook positioned on an upper side, and the contacting point part and the hook coupled and integrated at the base.

3. The connector for a flexible substrate according to claim 1, wherein said plurality of contacts are a plurality of first contacts attached from the front surface side and each including a soldering part on the front surface side, the connector further comprises a plurality of second contacts attached from the rear surface side and each including a soldering part on the rear surface side, and the body alternately holds the plurality of first contacts and the plurality of second contacts.

4. The connector for a flexible substrate according to claim 3, wherein the actuator further comprises a plurality of pressed parts, the pressed parts and the shafts being alternately arranged between the cams, and each of the plurality of second contacts includes a contacting point part for pressure contacting the corresponding one of the terminals on the end of the substrate, and a pressing part for elastically pressing a corresponding one of the pressed parts of the actuator from above when the actuator is in the closed state.

5. A connector for a flexible substrate comprising:

a body, configured to insert an end of the flexible substrate thereinto from a front surface side thereof, for holding a plurality of contacts arranged in parallel for respectively contacting a plurality of terminals arranged on the end of the inserted substrate; and an actuator, rotatably combined with the body, including a plurality of cams corresponding to the plurality of contacts within the body, and pressing the end of the inserted substrate with the plurality of cams by being turned form an opened state to a closed state so as to bring the terminals at the end of the substrate into contact with the corresponding contacts; wherein each of said contacts includes a contacting point part for pressure-contacting to a corresponding one of the terminals on the end of the substrate and a hook of hook shape for engaging and holding a corresponding one of shafts formed in the actuator;

the hooks engage the shafts from the front surface side so as to restrain the actuator from moving toward the front surface side;

the body includes a restraining part for abutting the plurality of cams from a rear side of the body so as to restrain the actuator from moving toward the rear surface side; and the actuator includes a cover for covering the rear surface side of the body when turned to the closed state.

6. The connector for flexible substrate according to claim 5, wherein said plurality of contacts are a plurality of first contacts attached from the front surface side and each including a soldering part on the front surface side, the connector further comprises a plurality of second contacts attached from the rear side surface and each including a soldering part on the rear surface side, the body alternately holds the plurality of first contacts and the plurality of second contacts, and the cover of the actuator has a configuration of covering the soldering parts of the second contacts.

* * * * *